US006802358B2

(12) United States Patent
Cser

(10) Patent No.: US 6,802,358 B2
(45) Date of Patent: Oct. 12, 2004

(54) METHOD FOR PRODUCTION OF AN OXIDATION INHIBITING TITANIUM CASTING MOULD

(76) Inventor: Sandor Cser, AM Oberen Bühl 13, 97350 Mainbernheim (DE)

( * ) Notice: Subject to any disclaimer, the term of this patent is extended or adjusted under 35 U.S.C. 154(b) by 0 days.

(21) Appl. No.: 10/204,681

(22) PCT Filed: Feb. 23, 2001

(86) PCT No.: PCT/DE01/00688

§ 371 (c)(1),
(2), (4) Date: Aug. 23, 2002

(87) PCT Pub. No.: WO01/62413

PCT Pub. Date: Aug. 30, 2001

(65) Prior Publication Data

US 2003/0011093 A1 Jan. 16, 2003

(30) Foreign Application Priority Data

Feb. 23, 2000 (DE) ..... 100 08 384

(51) Int. Cl.[7] ..... B22C 9/04
(52) U.S. Cl. ..... 164/34; 164/15; 164/520
(58) Field of Search ..... 164/34, 15, 520, 164/61

(56) References Cited

U.S. PATENT DOCUMENTS 3,552,479 A * 1/1971 Hockin ..... 164/65
4,700,769 A 10/1987 Ohara et al.

FOREIGN PATENT DOCUMENTS

| | | | |
|---|---|---|---|
| DE | 35 42921 | A1 | 6/1986 |
| DE | 36 24362 | A1 | 9/1987 |
| DE | 38 07495 | A1 | 9/1989 |
| DE | 38 31 539 | A | 3/1990 |
| DE | 39 21514 | A1 | 1/1991 |
| DE | 40 19818 | A1 | 1/1991 |
| DE | 44 12798 | C1 | 4/1995 |
| DE | 44 01475 | C1 | 6/1995 |
| DE | 196 07 380 | A | 10/1996 |
| DE | 296 21 480 | U | 3/1997 |
| GB | 725 456 | A | 3/1955 |
| JP | 61 009940 | A | 1/1986 |

* cited by examiner

*Primary Examiner*—Kiley Stoner
*Assistant Examiner*—Len Tran
(74) *Attorney, Agent, or Firm*—Collard & Roe, P.C.

(57) ABSTRACT

A method for producing a lost mold for titanium casting from a curable embedding compound. The embedding compound contains at least one oxidizable ingredient, such as zirconium. A model of an object to be cast is prepared from a material which can be melted out of the embedding compound. A mold is shaped by embedding the model in the embedding compound. The mold is cured and the embedding compound melted out by heating and holding the mold at a maximum temperature for a period of time. The mold is actively cooled to reduce the cooling time. Preferred embedding compound compositions and time-temperature profiles are disclosed.

2 Claims, 2 Drawing Sheets

METHOD FOR PRODUCTION OF AN OXIDATION INHIBITING TITANIUM CASTING MOULD

CROSS REFERENCE TO RELATED APPLICATIONS

Applicant claims priority under 35 U.S.C. §119 of German Application No. 100 08 384.6 filed Feb. 23, 2000. Applicant also claims priority under 35 U.S.C. §365 of PCT/DE01/00688 filed Feb. 23, 2001. The international application under PCT article 21(2) was not published in English.

BACKGROUND OF THE INVENTION

This invention relates to various methods of producing lost molds for titanium casting. Workpieces made of cast titanium are used to an increasing extent throughout the industry because of the excellent properties of the material and the relatively low price of titanium. Titanium is also being used to an ever greater extent in the field of technical dental applications in particular.

1. Prior Art

2. Field of the Invention

The procedure for producing a mold for titanium casting is essentially known. First, a model of the workpiece to be cast subsequently is created. To do so, preferably an especially suitable wax is used because it is good for modeling and can easily be burned out again later after embedding in the embedding compound. After modeling, a casting channel of wax wire is molded onto the model, and several models may be connected in series for one mold, depending on the size of the models. Then the model is mounted in a muffle ring or a muffle and various aids may be used such as cast rings and/or casting gate forming devices. Then the embedding compound is stirred and poured into the muffle so that the model is surrounded as a lost core and the desired mold is shaped in a negative form in the embedding compound. Next, the embedding compound is heated in a furnace according to a predetermined temperature-time profile and then cooled again. In the process, the embedding compound cures and the material of the model, which is to be melted out, is burned out of the mold. After the mold has cooled adequately, molten titanium may be cast in the mold immediately, so that the desired titanium cast part is obtained as the result.

One of the greatest disadvantages of titanium as a material is its relatively high tendency to oxidation. In casting titanium, the material tends to form an oxidation layer at the surface, which must be removed in a complicated process for most applications. The dimensional accuracy of the workpieces suffers due to this surface oxidation. Furthermore, manufacturing costs are increased because of the effort required to remove the oxidation layer. To prevent and/or minimize oxidation of titanium in casting, a variety of measures are known, aimed at influencing the casting operation itself in such a manner as to minimize oxidation. For example, it is known that molten titanium may be poured into the mold under a protective gas atmosphere.

However, experiments have shown that the surface oxidation of titanium depends to a significant extent on the manner in which the mold is processed in curing the embedding compound.

SUMMARY OF THE INVENTION

Therefore, the object of the present invention is to propose methods of producing a lost mold for titanium casting which will allow the production of cast titanium workpieces having minimal surface oxidation. This object is achieved by methods described herein.

Conventional commercial embedding compounds for titanium casting consist of a mixture of various oxides, containing mostly aluminum oxide ($Al_2O_3$) and magnesium oxide (MgO) in larger amounts. In addition, the embedding compound contains at least one additional component which can still be oxidized and in many cases consists of zirconium.

With the known methods, the zirconium should keep oxygen away from the molten titanium. However, this effect is achieved only inadequately, because the zirconium is already contaminated with oxygen in burning out the mold.

The methods according to this invention are based on the basic idea of at least limiting the contamination of the zirconium with oxygen in particular, while curing the embedding compound. This achieves the result that the greatest possible amount of unconsumed zirconium is available during titanium casting and therefore a larger amount of oxygen can be bound to the zirconium in the contact area between the titanium surface and the surface of the mold cavity. The amount of oxygen which is thus available for oxidation of titanium can be reduced in this way.

A first possibility of producing the mold is when the mold is cured under a protective gas atmosphere so that oxidation of the oxidizable component of the embedding compound is at least reduced. To do so, for example, the furnace may be purged with argon in curing the embedding compound. Of course, all other types of protective gases are also conceivable. It should be pointed out here that essentially the entire surface of the mold cavity must be adequately supplied with protective gas. To do so, for example, protective gas may be introduced into the interior of the mold so that the mold cavity is purged with protective gas.

The same effect of minimizing oxidation of the embedding compound during curing can also be achieved if curing of the mold takes place in an atmosphere with a decreased gas density. To do so, a reduced pressure or a vacuum may be established in the furnace in curing the embedding compound. Due to the decreased gas density in the interior of the furnace, fewer oxygen atoms are available for oxidation, so that oxidation processes are decreased on the whole.

Both the curing of the embedding compound under a protective gas atmosphere and curing with a decreased gas density require a certain additional complexity in terms of equipment. Very good results in minimizing oxidation of the titanium surface, however, are possible even without this additional expenditure in production of the mold. The relative degree of oxidation of the embedding compound, i.e., the ratio of the unoxidized embedding compound to the amount of oxidized embedding compound depends to a significant extent on the temperature to which the embedding compound is exposed and the duration of this exposure at a certain gas density. Consequently, high temperatures, high gas densities and a long exposure time lead to a high degree of oxidation. By decreasing the exposure time to high temperatures on the embedding compound, it is thus possible to decrease the oxidation of the oxidizable constituents of the embedding compound.

It is important to point out there that the holding time during which the temperature in the interior of the furnace is kept largely constant after reaching a maximum temperature (e.g., 850° C.) should be adapted to the quantity of embedding compound used. Because of the high temperature in the interior of the furnace, such a low gas density prevails in the interior of the furnace during the holding time that oxidation of the embedding compound is relatively minor during this period of time. Due to cooling of the interior of the furnace after the end of the holding time, the gas density in the interior of the furnace increases again drastically. Most of the oxidation therefore takes place during cooling of the mold because in this phase of the process, sufficiently high temperatures prevail for oxidation of the embedding compound and sufficiently high gas densities for a supply of atmospheric oxygen also prevail in the interior of the furnace.

According to another variant of the method according to this invention, the mold is therefore actively cooled after reaching and holding a maximum temperature, i.e., after the holding time at the maximum temperature has elapsed, in order to shorten the cooling time. The cooling should be so intense that cracking of the mold due to a great temperature stress is ruled out.

Since the measure of the allowed cooling is limited by the maximum temperature stability and the quantity of embedding compound cured, special coolants are not usually necessary. Instead, it is usually adequate if room temperature air from the ambient atmosphere is supplied to the mold for cooling. This may be achieved, for example, by the fact that the oven is not simply turned off after the end of the holding time and the mold allowed to cool slowly in the closed interior of the furnace, but instead the furnace is opened after turning off the heating and the atmosphere in the interior of the furnace is thereby exchanged with the room temperature ambient atmosphere. To increase the cooling effect with ambient air, other aids such as fans which ensure a forced flow may of course also be used.

Oxidation of the embedding compound can be further minimized if cooling of the mold is achieved by supplying a protective gas to the process-relevant area of the mold. Due to the flow of the cooler protective gas around the mold, the mold is cooled on the one hand, while on the other hand oxidation processes are prevented by displacement of atmospheric oxygen.

Another possibility of having a positive effect on the degree of oxidation of the embedding compound is to heat the furnace at a heating rate of at least 7° C. per minute or faster in curing the mold until reaching the maximum temperature. Since normally the furnace is heated at a rate of only 6° C. per minute, this measure makes it possible to achieve the maximum temperature more rapidly, so that as a result the dwell time of the embedding compound is in turn shortened even during the heating phase in the heated furnace.

In the production of molds weighing between 80 g and 1,000 g, such as those typically used for technical dental casts, a variant of the method which is characterized by the following steps has proven to be particularly advantageous:

First a model is prepared of the cast object and attached by means of casting channels made of a suitable material such as wax to a casting gate shaper in a muffle ring or the like. Then the embedding compound is stirred with a specified amount of pasting liquid such as water and poured into the muffle, whereby the cast object is completely surrounded and thus the desired mold is imaged in a negative form in the embedding compound. Then the muffle together with the casting gate shaper is put under an excess pressure in a pressure pot in order to thereby further compress the embedding compound. Then the embedding compound is cured at room temperature for at least 30 minutes, and next the casting gate shaper is removed. Then the muffle is introduced into a cold furnace and the furnace is heated at a heating rate of at least 7° C. per minute up to a temperature of 850° C. This holding temperature is then maintained at a constant level for approximately 30 minutes. Next the furnace is turned off and the furnace interior is cooled for approximately 15 minutes by opening the door of the furnace. Then the mold is placed on the edge of the furnace opening or on the furnace register in order to thereby intensify the cooling effect. The mold is left in this location for approximately 15 minutes for cooling. To further increase the cooling effect, the mold is then placed outside the furnace and again left to stand until reaching the desired temperature for the casting operation. Thus, the method according to this invention for producing the titanium casting mold is concluded and the molten titanium is poured into the mold cavity at approximately 150° C., for example, i.e., before the mold has completely cooled.

The method proposed here may of course also be carried out when individual or several of the above-mentioned parameters are modified or omitted entirely.

According to a preferred embodiment of this method, the individual steps of the method are automatically carried out in a device suitable for this purpose. This makes it possible to save on personnel costs and increase the reproducibility of the results.

A formulation of the embedding compound which is especially suitable for this method consists of 0 to 1% $SiO_2$, 0% to 1% $TiO_2$, 10% to 40% $Al_2O_3$, 0% to 2% $Fe_2O_3$, 0% to 1% MnO, 40% to 80% MgO, 2% to 10% CaO, 0% to 2% $Na_2O$, 0% to 1% $K_2O$, 0% to 1% $P_2O_5$ and 0% to 5% Zr. The amount of individual ingredients may be varied within the limits given in percent by weight (wt %). Other ingredients may also be added and individual ingredients may also be replaced by other substances having similar properties.

The methods according to this invention may be used to produce any type of molds intended for titanium casting. It is especially advantageous to use the method according to this invention to produce molds for technical dental titanium casting because especially high demands are made of the quality of the cast items to be produced in this area of technical applications.

BRIEF DESCRIPTION OF THE DRAWINGS

This invention will now be explained in greater detail on the basis of two diagrams which are shown as examples. They show.

DETAILED DESCRIPTION OF THE INVENTION

Figure 1:
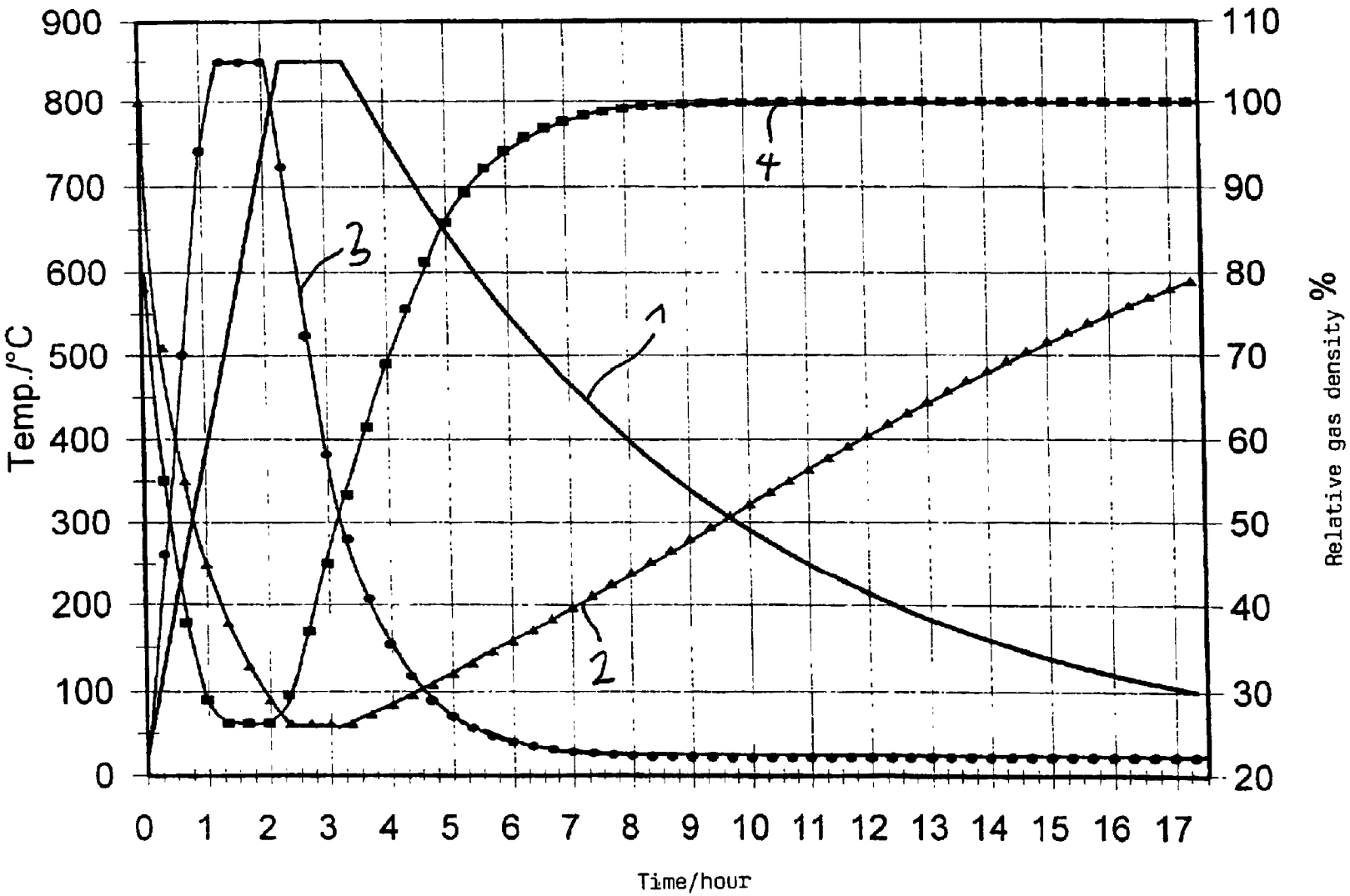
FIG. 1 the temperature and/or gas density plotted as a function of time in a production process according to this invention in comparison with a conventional production process.

In the diagram shown in FIG. 1, the temperature and the relative gas density are plotted as a function of time during curing of the embedding compound in the firing furnace. Graph 1 shows the temperature curve in a firing method known from the related art. Graph 2 shows the respective curve of the relative gas density in the furnace as a function of time. In comparison with these, graphs 3 and 4 show the temperature curve and the curve of the relative gas density respectively as a function of time such as those measured in a method according to this invention. It can be seen here that with the method according to this invention, the holding temperature of 850° C. is achieved more rapidly by using a higher heating rate than with the conventional method. The duration of the holding time during which the holding temperature of 850° C. is kept constant in the furnace is shortened by only a few minutes. The main difference between the two graphs 1 and 3 is that in the case of the method according to this invention, the temperature curve after the end of the holding time drops back to room temperature within a relativity short period of time due to the active cooling, e.g., by opening the door of the furnace, so that oxidation processes are largely suppressed. In contrast with that the temperature drops slowly in the conventional method according to graph 1.

The curves shown in the graphs 2 and 4 for the relative gas density show that the relative gas density is inversely proportional to the temperature in the furnace. As soon as the temperature reaches its maximum at the holding temperature, the relative gas density reaches its minimum at approximately 25%. The relative gas density increases again only with a drop in the temperature in the furnace, and the relative gas density increases much more rapidly according to graph 4 in the method according to this invention because the temperature in the furnace drops more rapidly. Thus on the whole the diagram in FIG. 1 shows that in the method according to this invention, oxidation of the embedding compound can be minimized by shortening on the whole the exposure time to atmospheric oxygen at elevated temperatures.

Figure 2:
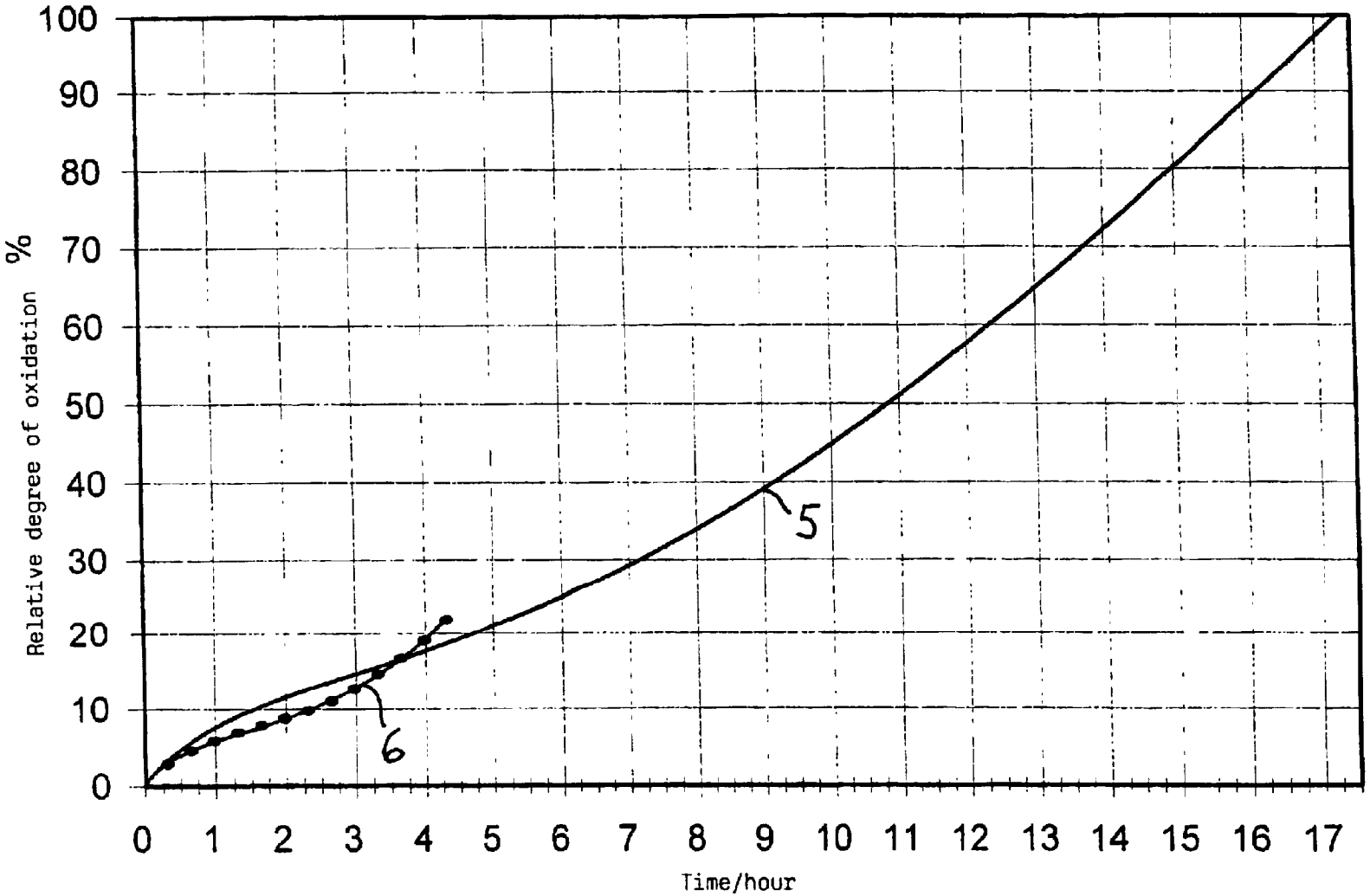
FIG. 2 the increase in relative degree of oxidation of an embedding compound during curing.

FIG. 2 shows a diagram in which the relative degree of oxidation of the embedding compound has been plotted as a function of time during curing. Graph 5 (conventional method) and graph 6 (method according to this invention) show the different relative degrees of oxidation that can be achieved by comparison in the conventional method and in the method according to this invention. Each is based on a temperature curve like that illustrated in FIG. 1. It can be seen here that the relative degree of oxidation increases almost in proportion to the duration of curing of the embedding compound. In the conventional method, a temperature of approximately 150° C. of the embedding compound, at which the titanium can then be cast into the mold cavity, is reached only after 15 to 17 hours, so the relative degree of oxidation increases greatly. In comparison with this, in the method according to this invention, the casting temperature of 150° C. in the embedding compound is reached after approximately one-half hour to two hours, depending on the quantity of embedding compound, so that the relative degree of oxidation at this time is only approximately 25% in comparison with 100% in conventional curing.

On the whole, it can be concluded that due to active cooling of the mold and more rapid heating, a significant decrease in the relative degree of oxidation can be achieved, which in turn results in a lower degree of oxidation of titanium in casting the molten titanium in the mold cavity.

What is claimed is:

1. A method for producing an approximately 80–1000 gram lost mold for titanium casting from a curable embedding compound which contains at least one oxidizing ingredient, the method comprising the steps of:

a) preparing a model of an object to be cast from a material which can be melted out of the embedding compound;

(b) fastening said model to a casting gate shaper in a muffle ring;

(c) mixing the embedding compound with a specified amount of a pasting liquid;

(d) coating the embedding compound by pouring over said model in a muffle;

(e) subjecting said muffle with said casting gate shaper to an excess pressure;

(f) curing the embedding compound for at least 30 minutes and then removing said casting gate shaper;

(g) placing said muffle in a cold furnace and heating said furnace to a holding temperature of 850° C. at a rate of at least 7° C./min.;

(h) holding said furnace at said holding temperature until the mold is thoroughly heated;

(i) turning off said furnace and cooling an interior of said furnace by opening a door of said furnace for approximately 15 minutes:

(j) placing the mold on an edge of an opening of said furnace or on a register of said furnace and allowing the mold to cool for approximately 15 minutes; and (k) placing the mold outside said furnace and allowing it to reach a desired temperature for a casting operation.

2. A method for producing a lost mold for titanium casting from a curable embedding compound which contains at least one oxidizable ingredient, the method comprising the steps of:

(a) selecting an embedding compound comprising a composition of 0 to 1 wt % $SiO_2$, 0 to 1 wt % $TiO_2$, 10 to 40 wt % $Al_2O_3$, 0 to 2 wt % $Fe_2O_3$, 0 to 1 wt % HnO, 40 to 80 wt % MqO, 2 to 10 wt % CaO, 0 to 2 wt % $Na_2O$, 0 to 1 wt % $K_2O$, 0 to 1 wt % $P_2O_5$ and 0 to 5 wt % Zr.

(b) preparing a model of an object to be cast from a model material which can be melted out of said embedding compound;

(c) shaping the mold by embedding said model with the embedding compound;

(d) curing said embedding compound and melting out said model material by heating the mold to a maximum temperature and holding the mold at said maximum temperature for a period of time; and (e) actively cooling the mold in order to reduce a cooling time.

* * * * *